US009513016B2

(12) United States Patent
Martin

(10) Patent No.: US 9,513,016 B2
(45) Date of Patent: Dec. 6, 2016

(54) BOTTOM-LOADING COOKING APPLIANCE

(71) Applicant: John Palmer Martin, Woodlawn (CA)

(72) Inventor: John Palmer Martin, Woodlawn (CA)

(73) Assignee: John Palmer Martin, Riverport, Nova Scotia (CA)

( * ) Notice: Subject to any disclaimer, the term of this patent is extended or adjusted under 35 U.S.C. 154(b) by 234 days.

(21) Appl. No.: 14/193,577

(22) Filed: Feb. 28, 2014

(65) Prior Publication Data

US 2014/0246008 A1 Sep. 4, 2014

Related U.S. Application Data

(60) Provisional application No. 61/771,395, filed on Mar. 1, 2013.

(51) Int. Cl.
*F24C 15/02* (2006.01)

(52) U.S. Cl.
CPC ..... *F24C 15/027* (2013.01)

(58) Field of Classification Search
CPC ..... F24C 15/027; F16M 11/24
USPC ..... 99/339; 126/334, 273 A
See application file for complete search history.

(56) References Cited

U.S. PATENT DOCUMENTS 5,518,086 A * 5/1996 Tyni ..... B66B 13/143 187/316
6,539,840 B2 * 4/2003 Choi ..... A47J 37/08 219/679
6,843,245 B2 1/2005 Herbst et al.
6,910,677 B1 * 6/2005 Miller ..... B66F 3/12 254/103
7,287,462 B2 10/2007 Dengler et al.
2002/0108500 A1 * 8/2002 Backus ..... A47J 37/041 99/326
2007/0246451 A1 * 10/2007 Willett ..... A21B 1/44 219/394
2008/0247855 A1 * 10/2008 Lee ..... B66F 9/06 414/546

* cited by examiner

*Primary Examiner* — Steven B McAllister
*Assistant Examiner* — Rabeeul Zuberi
(74) *Attorney, Agent, or Firm* — Ridout & Maybee LLP

(57) ABSTRACT

A cooking appliance is disclosed, comprising a wall-mounted cooking chamber, i.e. oven, with a bottom-opening door and separate countertop control panel, which facilitates use by individuals with disabilities, injuries or limited mobility, such as wheelchair users. The oven is wall-mounted, at a convenient distance, above a kitchen countertop, leaving a useful area of countertop underneath. Advantageously, it includes a low profile motor driven lift mechanism, housed against the wall beneath the oven and comprising guide rails for lowering the door to counter level and raising it to the closed, cooking position. The door provides a platform for items to be cooked. When lowered to counter level, a user can slide dishes between the platform and the adjacent countertop, without need for lifting as in a conventional stove or wall-mounted oven. An easy to reach, counter-level control unit enables the user to control oven functions including raising/lowering the door.

7 Claims, 8 Drawing Sheets

BOTTOM-LOADING COOKING APPLIANCE

CROSS-REFERENCE TO RELATED APPLICATION

This application claims priority from U.S. Provisional Patent Application No. 61/771,395, filed Mar. 1, 2013, entitled "Bottom Loading Cooking Appliance", which is incorporated herein by reference in its entirety.

TECHNICAL FIELD

This invention relates to kitchen appliances, and particularly to domestic cooking appliances comprising an oven, e.g. for baking and roasting, and also relates to kitchen appliances that facilitate use by individuals with disabilities or physical constraints.

BACKGROUND

Conventional kitchen designs are arranged with kitchen appliances including a stove or oven, and countertops of a standard height, typically with storage units under the countertops and wall storage cabinets above. This type of arrangement poses a number of problems to people with limited mobility, including those who use a wheelchair, or those that have limited reach or ability to lift items in and out of a conventional cabinet or kitchen appliance which is above or below the countertop level. A standard kitchen layout is arranged for an adult person of average height, assuming an average level of mobility and dexterity. Adjusting counter heights or providing space underneath counters may assist some users, e.g. wheelchair users.

However, in most existing homes and kitchens, use of a conventional oven, e.g. for baking or roasting, requires lifting and handling of larger hot and/or heavy dishes. This poses particular problems. Even when a person is able to prepare and cook foods on the countertop or stove top, they may need assistance from others to lift and load/unload dishes from the oven, regardless of whether the oven is part of a stove or range, or a wall-mounted built-in oven. As an example, an individual with severe arthritis and limited grip strength may be able to prepare food on the countertop with suitably adapted tools and utensils, and may be able to cook on a cooktop by sliding pots or pans from the counter onto the cooktop, and back again, without lifting. However, with limited grip and strength to be able to lift dishes off the countertop into the oven and back again, assistance from another person is required to lift dishes in order to use a conventional oven, or even a countertop microwave oven. Clearly, this can be very frustrating and limits a person's independence, as well as menu choices. Thus, it would be desirable to provide cooking appliances that address this problem to enable such individuals to be able to cook more independently.

Existing commercially available domestic kitchen appliances for cooking include what are referred to as ranges (in North America), otherwise referred to as stoves or cookers (in UK), comprising an oven and a cooktop in a single unit, typically allocated a 30" space (North America) or 24" space (Europe) in a conventional kitchen design. Such stoves or ranges usually have an oven with a door that is hinged at the bottom and opens downwards.

Another common arrangement is to have a separate cooktop that is mounted in the countertop, with storage underneath, and a separate wall-mounted, built-in oven, placed above countertop level within a cabinet, and having a bottom-hinged or side-hinged oven door. Smaller countertop ovens, including microwave ovens and toaster ovens are also known, having side-hinged or bottom-hinged doors. Microwave ovens may be countertop models which can be placed on the countertop or on an elevated shelf, or on an under-counter shelf. Built in microwave models are also known, having a bottom hinged door for wall-cabinet mounting or under-counter mounting, and more recently a microwave drawer configuration has become available. Nevertheless, all these configurations are effectively "front-loading".

In alternative configurations, such as disclosed in U.S. Pat. No. 7,287,462 to Dengler and U.S. Pat. No. 6,843,245 to Roch, both entitled "High-Level Built-In Oven Unit", it is also known to have wall-mounted ovens that are bottom-opening with a motor driven lift door/platform, e.g. commercially available Bosch or Gaggenau LiftMatic™ ovens.

The drive mechanism for raising and lowering the door is mounted within the oven housing, with extension slide arms that extend to lower the door into the open position and retract into the housing to close the door. However, it is apparent, from the arrangement of the controls that these appliances are designed for use by able bodied and average height users who can reach the high level control panel on the door panel, i.e. when the oven is closed. Even for able bodied users, such designs pose problems for cleaning and maintenance, e.g., is difficult to reach inside the oven for cleaning.

Thus, there is a need for alternative or improved cooking appliances that enable or facilitate use by individuals with physical challenges and/or address other problems mentioned above.

SUMMARY OF INVENTION

The present invention seeks to mitigate disadvantages of known cooking appliances and ovens, or at least provide an alternative.

According to one aspect of the present invention there is provided a cooking appliance comprising: a housing containing a cooking chamber (oven) for wall-mounting above a countertop, the cooking chamber having a bottom-opening door that provides on its upper surface, a platform for items to be cooked;

a lift/drive system disposed beneath the housing of the cooking chamber, extending from a back of the housing to countertop level, the door being cantilever mounted on the lift/drive system for moving the door between a raised (closed) position and a lowered (open) position; and a control panel remote from the cooking chamber and the door.

The oven door is preferably relatively thin, and lowers to countertop level, so that dishes or other items to be cooked can be loaded on and off the platform from the countertop without needing to lift the dishes very far. Dishes can preferably be slid between the countertop and the platform without lifting.

To reduce the door thickness, all power for the heating elements is preferably provided within the wall-mounted housing of the oven chamber, i.e. in the top or side walls of the oven.

Beneficially, for accessibility, the control panel is provided remote from the cooking chamber and the door, e.g. a separate remote control panel unit is mounted at countertop level or just below the underlying countertop. The control panel provides for controlling oven functions and raising and lowering of the door. A low-voltage all-electronic control panel may be coupled to the cooking appliance by a low-voltage connection such as a Cat 5 ethernet cable.

In a preferred embodiment, the mechanical and electrical components of the lift/drive system extend against the wall underneath the cooking chamber of the oven. The drive mechanism is low profile so it can be housed behind a cover panel against the wall, leaving the workspace on the counter area open beneath the oven when the oven is closed. Thus, the wall-mounted drive mechanism is thus not significantly exposed to oven heat. The cover panel may act as a backsplash for the counter area beneath the oven, e.g. it keeps the drive mechanism clean.

Preferably, the lift/drive mechanism preferably comprises guide rails (e.g. a pair of guide rails) extending down each side, from the back wall of the housing of the oven chamber to a countertop height. The lift/drive mechanism comprises a motor driven lift having a support bar for the door extending between the guide rails with bearing guides, at each end of the support bar, running in the guide rails. The support bar has bearings at each end that run in the rails. The door is supported on cantilever arms extending forwardly from the support bar. The lift mechanism advantageously comprises a scissor-jack type of drive, driven by a worm gear, e.g. with opposing threads each side, turned by a low power motor. Such a lift/drive arrangement provides stability for reliably raising and lowering significant loads on the door/cooking platform, without risk of the door/platform wobbling or tipping, e.g. causing spills of hot liquids. Such a lift/drive is also able to handle uneven loading of the cooking platform. It can also be driven almost silently using a low power motor.

Advantageously, sensors such as load sensors and pressure sensors are provided to sense weight overload on the cooking platform or an imbalanced load which may spill or tip. Load sensors are also used to detect objects blocking opening or closing of the door, and prevent trapped fingers, etc.

Beneficially, a second door is also provided at the front of the cooking chamber to allow access for cleaning and maintenance If this door is side hinged, it is preferably a reversible left or right hinged door to allow more flexible placement and facilitate used by left or right handers. An alternative set of controls may also be provided on the housing of the cooking chamber for the convenience of standing users.

According to another aspect of the invention there is provided a lift/drive system for a bottom-loading cooking appliance.

According to yet another aspect of the invention there is provided a unit comprising a remote control panel for a cooking appliance.

A further aspect of the invention provides a cooking appliance comprising: a first unit comprising a housing containing a cooking chamber (oven) for wall-mounting above a countertop, the cooking chamber having a bottom-opening door that provides, on its upper surface, a platform for items to be cooked; motor driven means for raising and lowering the door between a raised (closed) position and a lowered (open) position; and another unit comprising a control panel, remote from the housing of the cooking chamber and the door, for controlling oven functions and for raising and lowering the door.

The foregoing and other objects, features, aspects and advantages of the present invention will become more apparent from the following detailed description, taken in conjunction with the accompanying drawings of a preferred embodiment of the invention, which description is by way of example only.

BRIEF DESCRIPTION OF DRAWINGS

In the drawings, identical or corresponding elements in the different Figures have the same reference numeral.

DETAILED DESCRIPTION OF EMBODIMENTS

Figure 1:
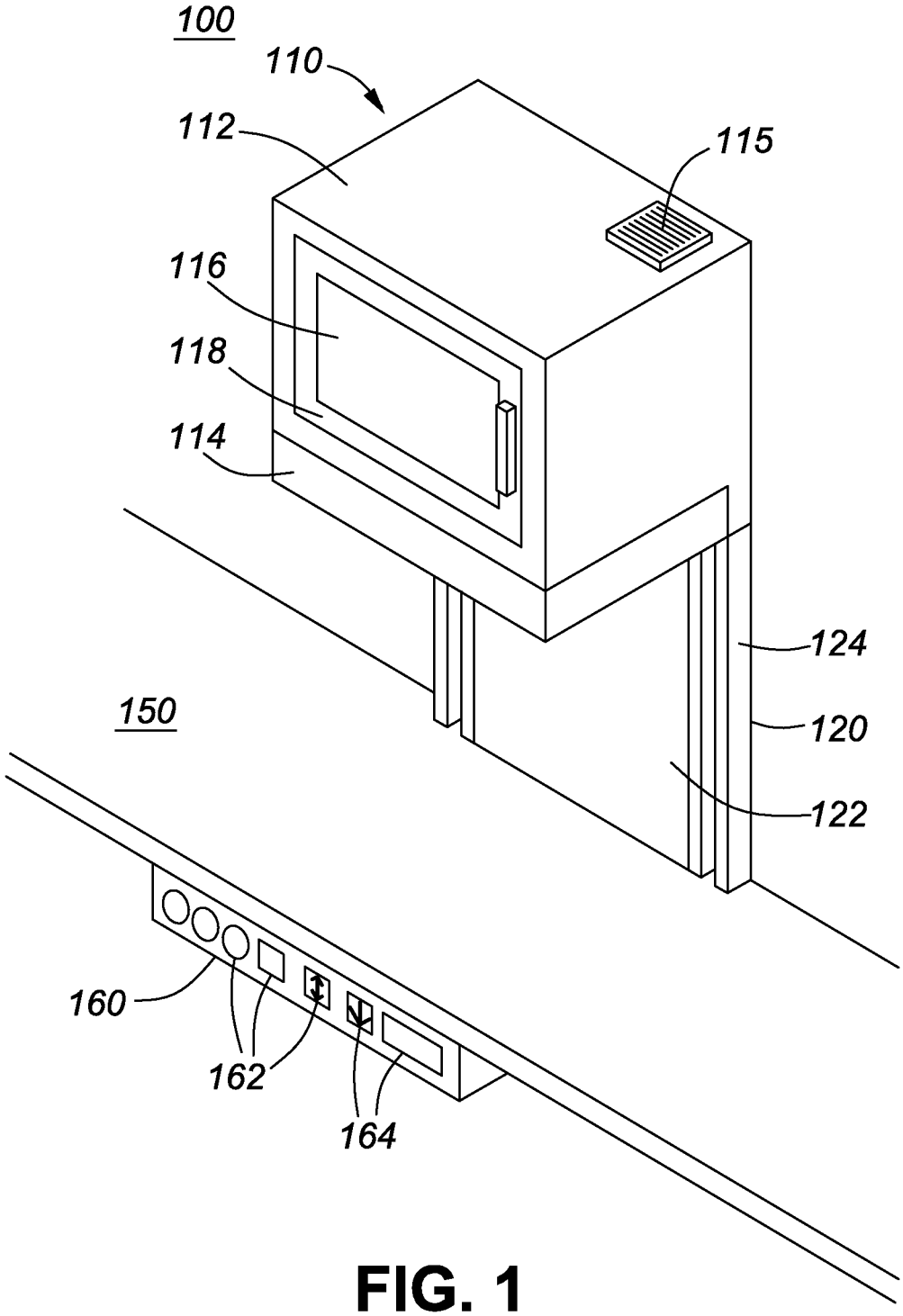
FIG. 1 shows a perspective view of a bottom-opening, wall-mounted, oven according to an embodiment of the present invention, in the closed position.

FIG. 1 illustrates a cooking appliance 100 comprising a wall-mounted unit 110, comprising a cooking chamber 112, i.e. an oven, having a bottom-opening door 114 mounted above a work area on a countertop 150. The door 114 is raised and lowered by a drive system 120, comprising guide rails 124 extending against the wall beneath the oven. A cover plate 122 hides the lift/drive mechanism, which is shown in more detail in FIGS. 3 to 8.

The door 114 is cantilevered from a support bar (not visible in this Figure) that extends between guide rails 124 on each side of the housing 122. The appliance is shown in FIG. 1 with the door closed, i.e. the door/platform 114 is raised. The drive system 120 for raising and lowering the door is low profile against the wall to leave the workspace free on the countertop underneath the oven unit 110. Controls 162 are provided by a separate unit, i.e. a remote control panel 160 that is mounted just below the countertop 150. The control panel provides controls 162 for conventional oven control functions together with controls for door opening (down) and door closing (up) functions, and an easy to read display 164. Thus, the controls on the panel 160 are readily accessible, within easy reach at countertop level, whether the oven is closed or open.

Figure 2:
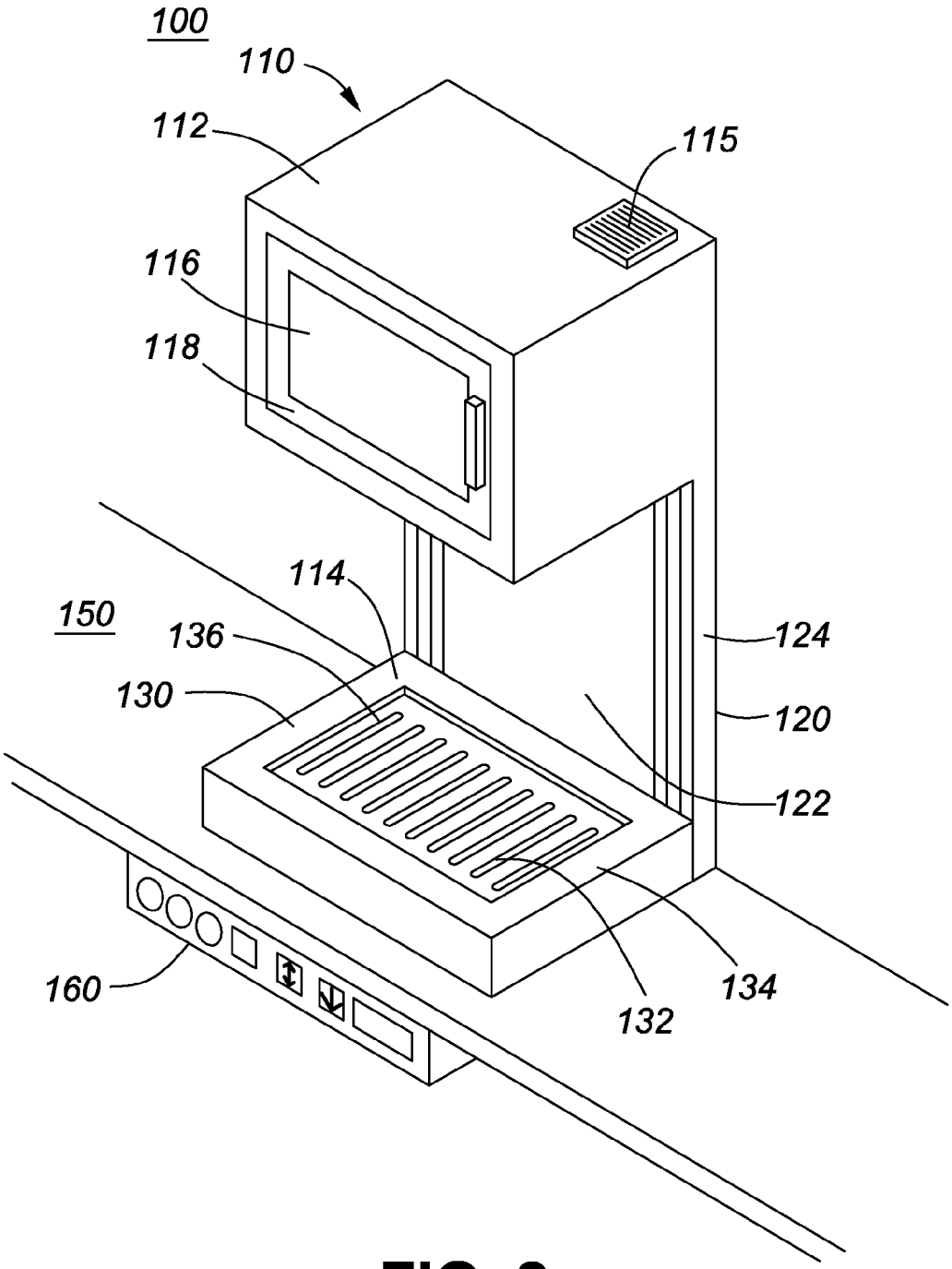
FIG. 2 shows a perspective view of the oven according to the embodiment, in the open position.

FIG. 2 shows the appliance in the open position, with the door 114 lowered to the countertop 150. The door 114 provides an upper surface or platform 130 having an area 132 on which items or dishes to be cooked may be placed. A surrounding area 134, i.e. around the edges of the door 114, closes against a seal (not shown) on the bottom face of the oven chamber 112 when the door 114 is closed. The area 132 is slightly recessed to define the area for placing cooking pots, and as illustrated, may comprise shallow ribs 136, e.g. like a roasting pan, to form a drip tray to catch spills.

Figure 3B:
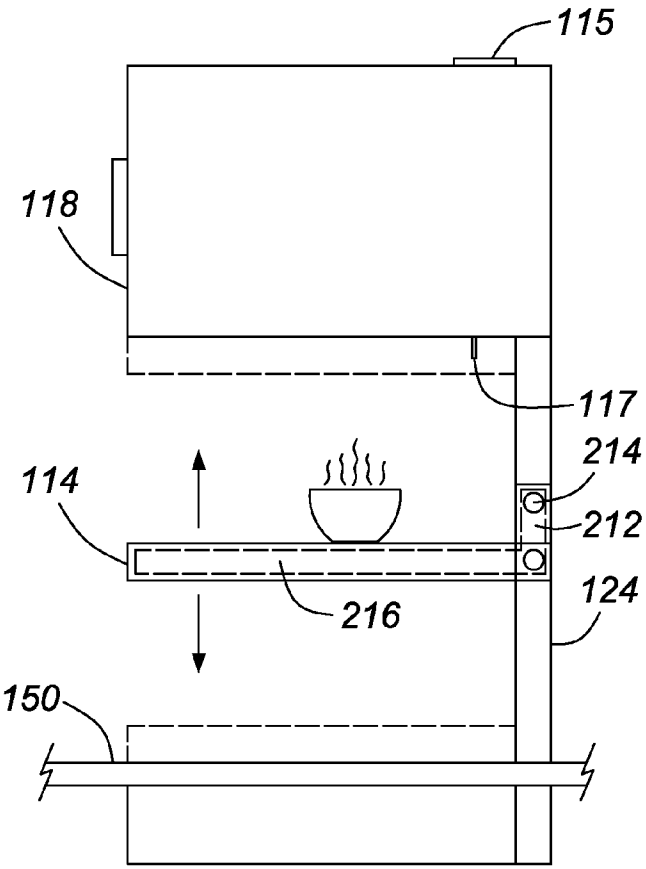
FIG. 3B shows a side view of the oven of the embodiment with the door positioned midway between the open and closed position.
Figure 3A:
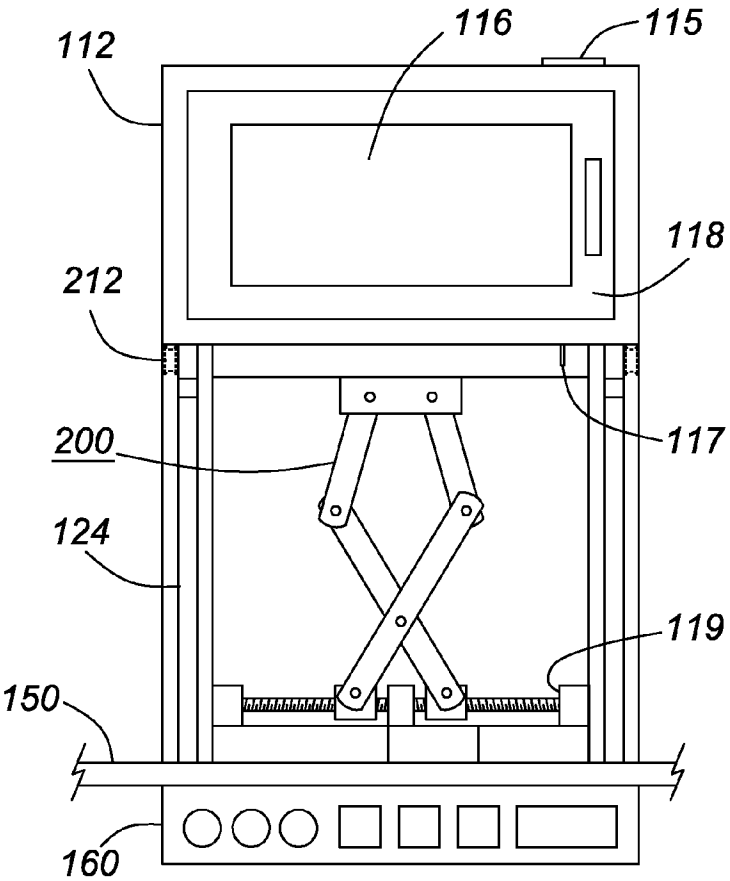
FIG. 3A shows a front view of the oven of the embodiment with the front panel removed to show part of the drive/lift system which is illustrated in more detail in FIGS. 4 to 7.
Figure 4:
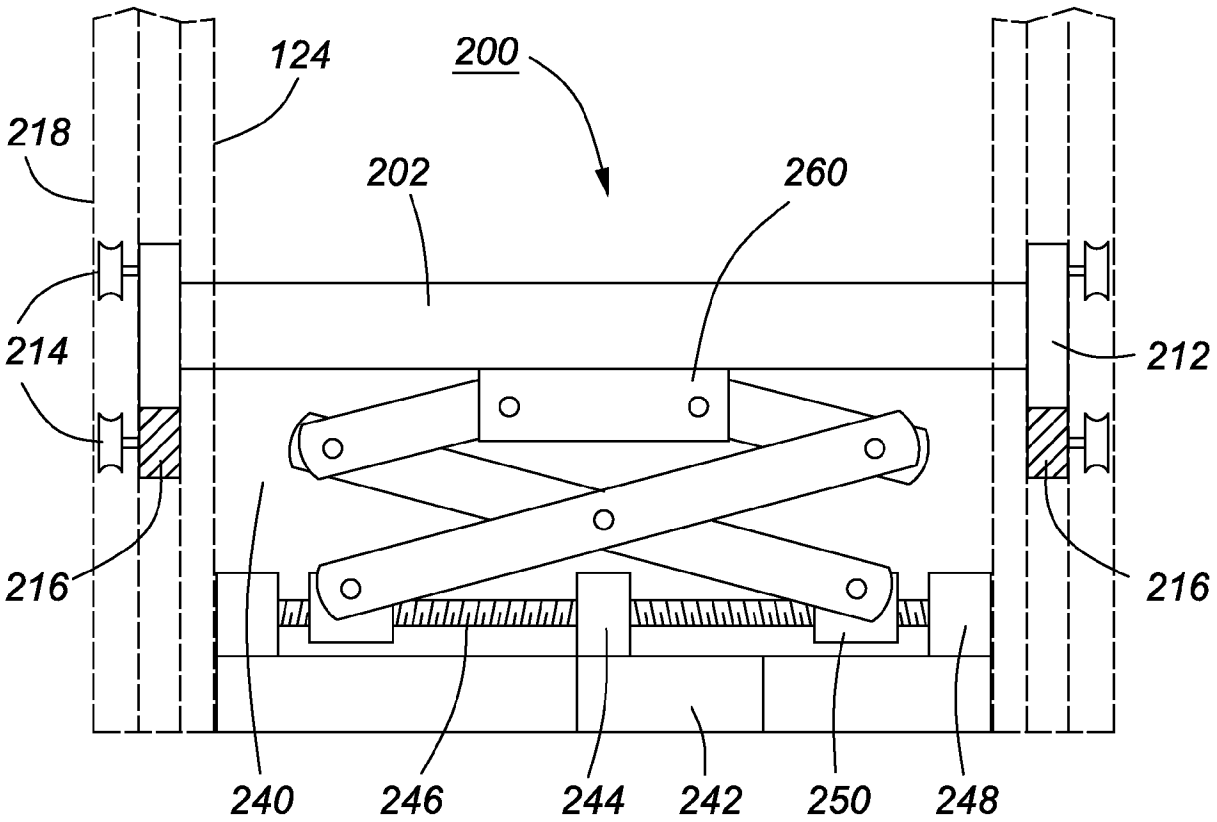
FIG. 4 shows a front view of the drive/lift mechanism in a partially lowered position.
Figure 5:
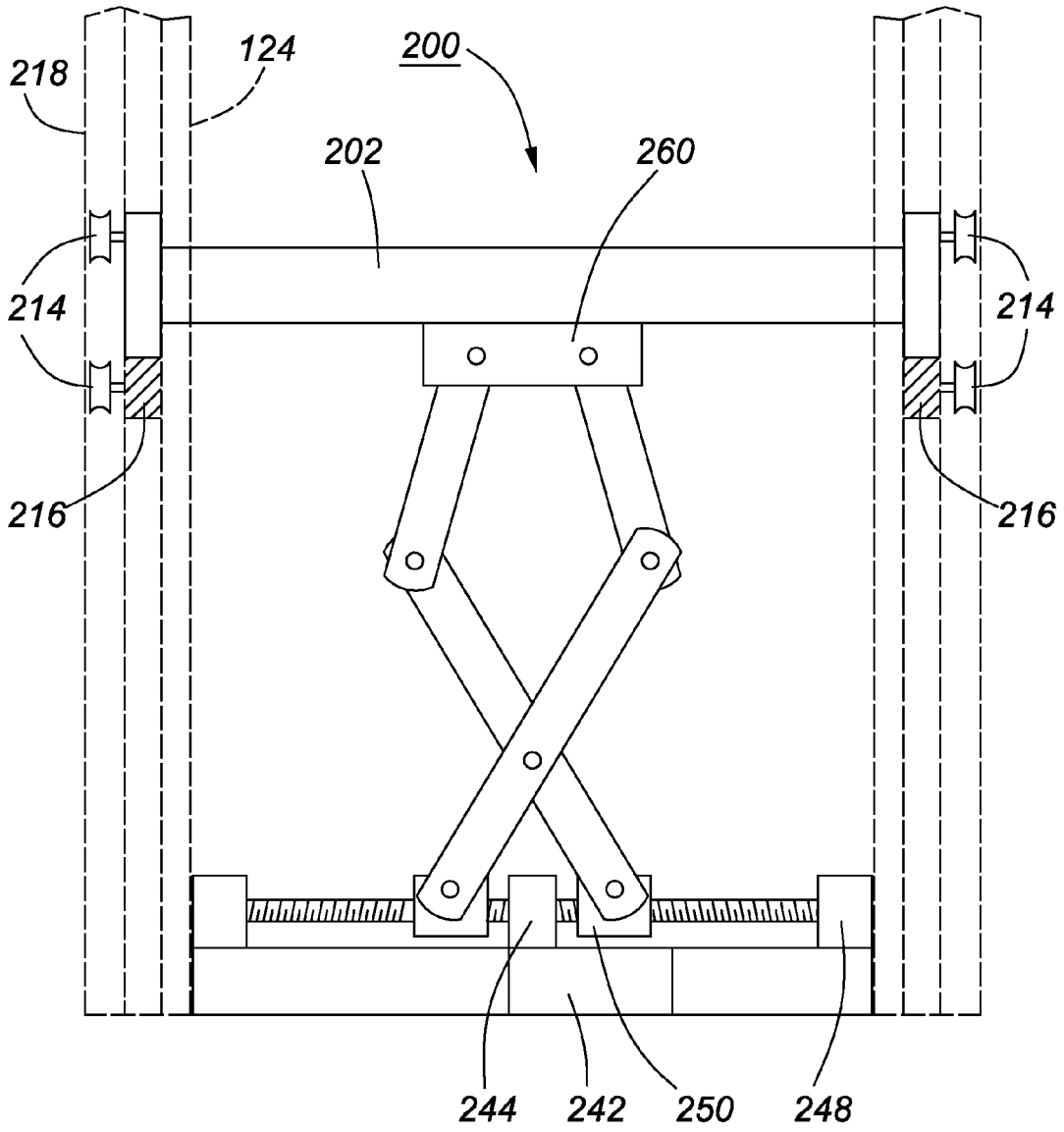
FIG. 5 shows a front view of the drive/lift mechanism in a raised position.
Figure 6A:
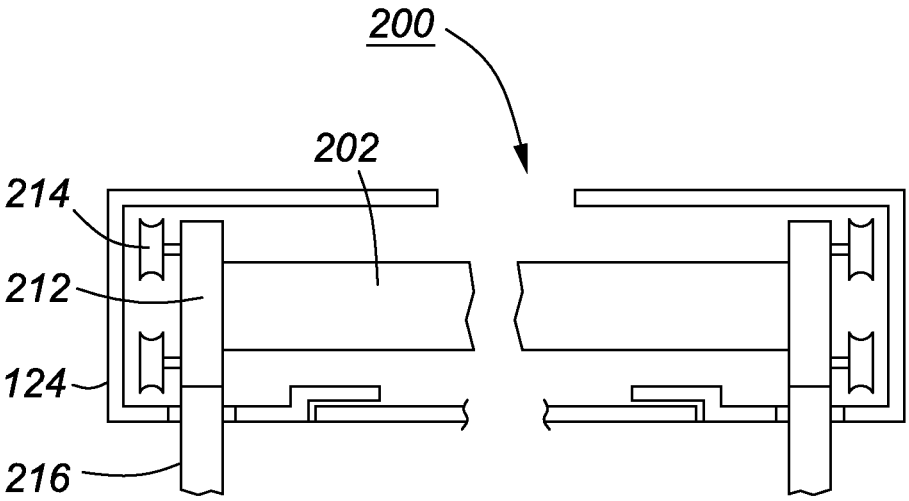
FIG. 6A and FIG. 6B show, respectively, a top view and a front view of the guide rails for the drive/lift mechanism.
Figure 6B:
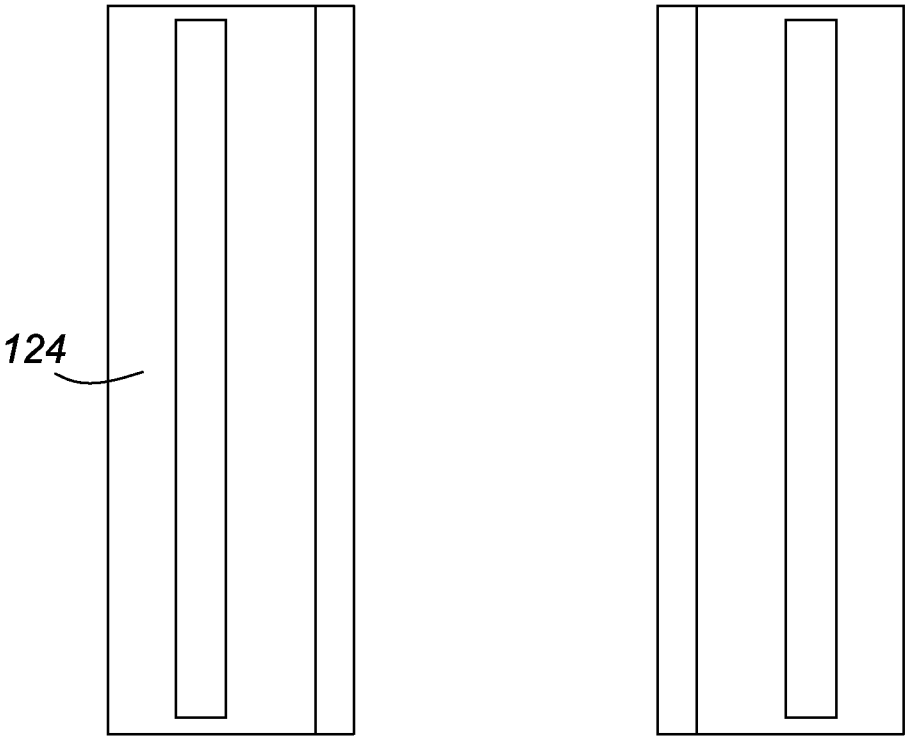
Figure 7A:
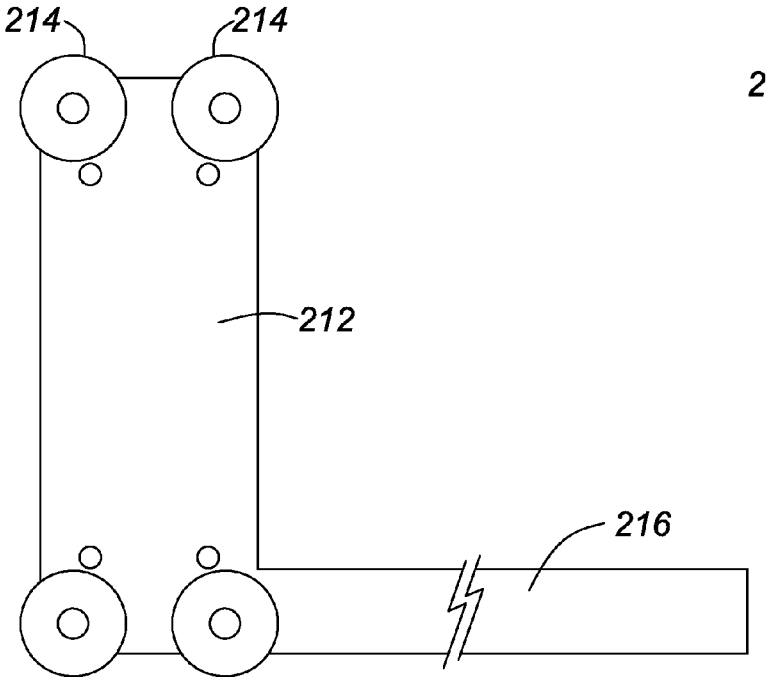
FIGS. 7A, 7B and 7C show, respectively, a lateral view, top view and front view of the supports comprising the bearings/rollers that run in the guide rails and the support arms that hold the door.
Figure 7C:
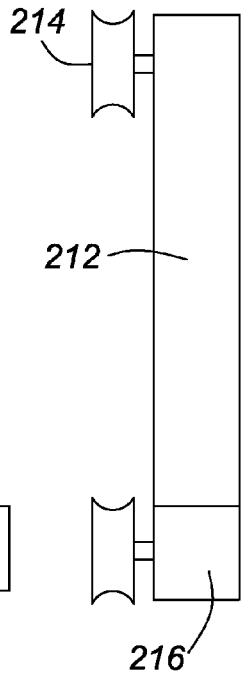
Figure 7B:
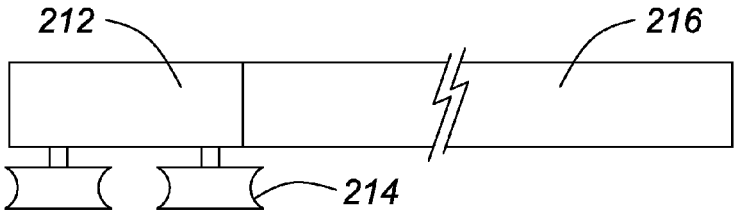
Figure 8:
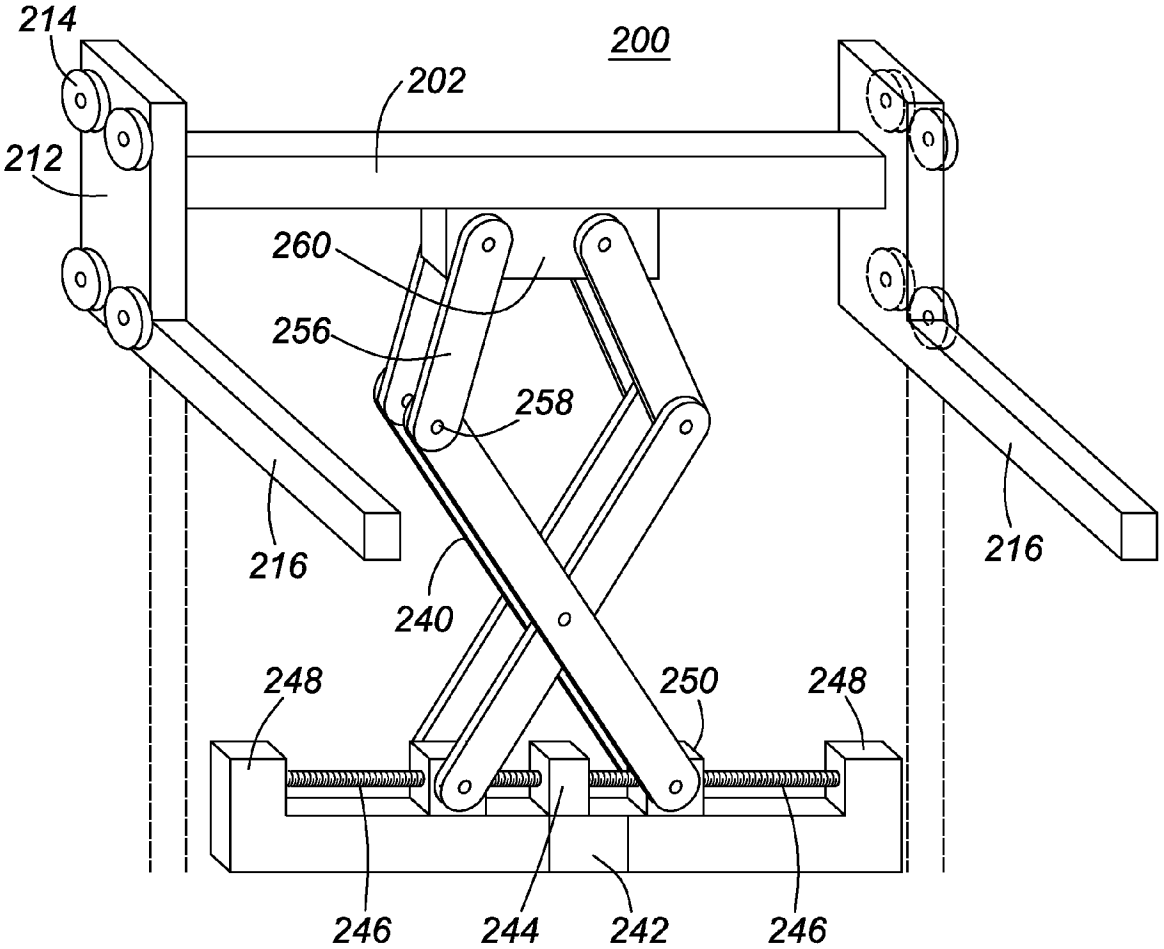
FIG. 8 shows a perspective view of the drive/lift mechanism, with the guide rails removed, including the cantilever arms extending from the side supports, for supporting the oven door.

FIG. 3A shows a front view of the cooking appliance 100 with the cover panel 122 of the housing of the lift/drive system 120 removed to reveal the lift/drive mechanism 200, which will be described in more detail with reference to FIGS. 4 to 7 (see below—section heading Lift/Drive System). FIG. 3A shows the drive mechanism 200 in the raised position. FIG. 3B shows a side view of the oven 100 with the door 114 positioned between the open and closed position, with a cooking pot supported on the platform 130. The door 114 is supported on a support structure comprising cantilevered arms 216 extending from side supports 212 carrying roller bearings 214 that run in guide rails 124.

As shown in FIGS. 1 and 2, the cover panel 122 of the housing 120 of the lift/drive mechanism 200 may act as a backsplash for the counter area beneath the oven unit 110, which keeps the drive mechanism clean and free of obstructions. Since the lift/drive is external to, and extends beneath the oven chamber, unlike prior art arrangements, the drive mechanism is not significantly exposed to oven heat or cooking vapours, as it would be if it was housed within the housing of the cooking chamber 112.

As illustrated in FIGS. 1 to 3, a front-opening door 118 is provided for access for cleaning and/or maintenance The oven chamber 112 has a front window 116 for viewing items cooking. As is conventional, the oven may include a light and venting. For example a vent 115 may be provided in the top of the oven A sensor or switch 117, such as a pin or push switch, may be provided to operate when the door is opened/closed, e.g. to control the light and vent. A position sensor 119 may be provided as part of the lift mechanism to monitor the lift position, e.g. to indicate whether the door is open or closed position or somewhere in between.

Additional controls or indicator lights, or a secondary control panel, may optionally be placed on the exterior of the oven chamber (not shown). However, the main controls are mounted in the separate unit 160 which is easily accessible at counter height, e.g. for a seated user.

It is desirable that the door 114 is as thin as feasibly possible, e.g. 1 or 1.5 inches thick, so that dishes may be slid more easily on and off the platform when the door 114 is lowered to the countertop level.

Lift/Drive System

As illustrated in FIGS. 3A to 8, the lift/drive system comprises guide rails 124, i.e. a pair of guide rails, extending down each side, from the back wall of the housing 110 of the oven chamber 112 to a countertop height 150, and a motor driven lift 200 having a support structure comprising a support bar 202 extending between the guide rails 124 with support brackets 212 comprising bearings 214 at each end of the support bar, running in the guide rails 124. The lift mechanism preferably comprises a scissor-jack type of drive 240. The drive 240 is powered by a low power motor 242, coupled by a gearbox 244 to a worm gear 246, e.g., with opposing threads each side, turned by the motor 242. The worm gear is supported at each end by bearings 248 and also by carrier bearings 250, to which the upper and lower scissor-jack arms 240 and 256 are pivotally coupled by pivot pins 258. The upper arms 256 of the scissor-jack are similarly coupled to the upper bracket 260. Support bar 202 is connected to the upper bracket 260 of the lift mechanism.

The support structure that carries the oven door comprises support brackets 212 that are provided at each end of the support bar 202, carrying bearings 214 which run in the guide rails 124. Cantilever arms 216 extend from the brackets 212, forward of the support bar 202 (see FIGS. 7 and 8) for attachment of the door 114. The arms 216 are positioned relative to the support bar 202, e.g. as shown in FIGS. 3A and 3B, so that over the range of motion of the lift mechanism, the door can be moved between the closed and open positions. That is, in a fully closed position, the scissor-jack is raised and the brackets 212 are retracted partly behind the over chamber 112. In a fully open position, the scissor-jack is lowered, so that the door 114 is brought to countertop level.

Such a lift/drive arrangement 200 provides a mechanically stable drive for reliably raising and lowering significant loads on the door and cooking platform using a low power motor, without risk of the door and platform wobbling or tipping, e.g. causing spills of any liquids. For example, at maximum load, depending on the oven capacity, the door may be rated to lift a 25 lb/10 kg cooking load, for example, to accommodate a large casserole or a roasting pan with a Thanksgiving turkey. This type of lift/drive is also able to handle uneven loading of the cooking platform. It can also operate almost silently.

Remote Control Panel

Desirably, for accessibility, the control panel 160 is a separate unit, provided remote from the cooking chamber, e.g. as a separate control panel that can be mounted at countertop level or just below the underlying countertop 150. The control panel 160 includes regular or conventional oven functions 162, such as temperature control and a timer, plus functions to raise and lower the oven door/platform 114. The panel may also include one or more indicator lights, audible alerts or display panels 164. An example of a control panel layout is represented schematically in FIGS. 1 to 3A, although any suitable arrangement of controls and display panels may be used. The control panel preferably has large controls 162, i.e. knobs or pushbuttons that can easily be used by someone with limited grip or manual dexterity. Any digital display panels are also configured to be easy to read. A low-voltage, all-electronic control panel may be connected to the cooking appliance by a low-voltage connection such as Cat 5 Ethernet cable.

Sensors and Safety Features

Advantageously, sensors such as load sensors and pressure sensors are provided to sense weight overload on the door and platform or an imbalanced load which may spill or tip, to detect objects blocking opening or closing of the door, and e.g. to prevent trapped fingers. Load sensors may comprise part of the motor drive. That is, a sudden or unexpected increase in load on the motor may be used to detect an obstruction, and cause the motor to stop and/or reverse.

Sensors may also be arranged to provide information relating to the door position, i.e. door position sensors that provide positional information on whether door is fully open or closed, or at an intermediate position. Other advanced control functions, if required, may use inputs from pressure, load and position sensors. Such functions may be coupled to safety controls and/or oven vent controls.

For venting, typically, a conventional oven has a vent near the top for venting excess steam and hot air during cooking. In a bottom opening oven, due to convection, leaving such or a vent open when the oven door opens results in venting of a significant amount of hot air while the door is open. To conserve heat, advantageously the oven comprises a vent control. Such a vent control may be simple switch that closes the vent when the oven door is open and opens the vent when the oven door is closed, or an electronic controller that responds to feedback signals from door position sensors.

Sensor can be configured to suitable user feedback, i.e. an indicator light, beeper, to provide a visible or audible indication of the oven door position, such as open, closed, or moving through an intermediate position, load imbalance problem, or other operational issues.

Preferably, sensors are mounted and electrically powered within the main housing of the oven, so that there is no need for electrical connections for control electronics within the oven door itself Alternatively any door mounted sensors would be battery powered and wirelessly coupled to the main control panel for the oven.

Heating Source

The cooking chamber (oven) may be heated by any suitable power source and the heating elements are provided in the sidewalls or top of the oven chamber, so that power is not required to the door. Preferably, there is no heating element in the door. Thus, the door can be made thinner, and does not require power cabling.

For even heating, using elements in the sides or top of the oven, the cooking chamber preferably comprises an electric convection oven with a fan to provide for air circulation and even heating throughout the oven. The heating source may alternatively comprise a microwave source. The heating source may alternatively comprise a combination microwave with a browning element, for example. Other suitable heating elements or sources may alternatively be used.

The oven chamber is insulated, as is conventional, so that the exterior of the cabinet remains relatively cool. The door is also insulated so that the bottom surface of the door, which contacts the countertop, remains sufficiently cool and does not damage the countertop. However, since heat rises, the door may require less insulation than the sidewalls and top of the oven.

Cleaning and Maintenance

A second door is provided at the front of the cooking chamber to allow for access for cleaning and maintenance If this door is side hinged it is preferably a reversible left or right hinged door to allow for more flexible placement of the oven and facilitate use by left or right handers. It may have a pull handle, or a push button opening. Other alternative or additional controls may also be provided on the housing 110 of the cooking chamber, e.g. for the convenience of standing users. However, the main controls are provided on the separate counter level control panel 160.

Power

In the preferred embodiment, all high voltage power for the heating elements is provided within the housing 110 of the oven chamber. Any power cabling for the motor drive 200 is housed behind the cover panel. The control panel 160 is preferably a low voltage electronic panel. Power to the door/platform is preferably not required. It is also desirable that the door 114 with platform 130 is as thin as possible to facilitate loading and unloading by sliding dishes to and from the countertop 150. For example, the door may be 1 to 1.5 inches thick. For this reason, the door preferably does not include a heating element. This also avoids the need to feed power cabling for a heating element to the door.

The door 114 is preferably thin enough that dishes can be easily loaded and unloaded without significant lifting. For example, if the door is approximately 1 inch thick, a trivet or cutting board placed on the countertop next to the door allows dishes to be readily slid on and off the door/platform. The support surface or platform of the door preferably comprises a shallow recess to contain any spills. The recess may be in the form of ribs or a low profile rack, such as typical of the base of a roasting pan.

While embodiments have been described in detail above, it will be appreciated that modifications may be made to these embodiments. The oven is described as wall mounted and this term is intended to include any suitable mounting directly to a wall or supporting frame or cabinet that supports the over unit at a suitable height above a countertop level and provides clearance between the unit and an underlying countertop. The countertop may be a conventional kitchen cabinet counter surface, table top, or other suitable work surface area.

INDUSTRIAL APPLICABILITY

A cooking appliance is disclosed comprising a wall-mounted, bottom-opening oven with a motor driven door, and having a separate control panel, which is mounted at countertop level. When the door is lowered to countertop level, dishes or other items to be cooked can be loaded and unloaded by sliding to and from the countertop to the platform. The separate control panel and controls are readily accessible at all times whether the door is open or closed. This arrangement for a wall-mounted, bottom-loading oven with a separate control panel particularly facilitates use by seated users, or those with limited strength or mobility.

This configuration also provides an alternative mounting arrangement for a cooking appliance such as a microwave oven, which is typically shelf-mounted or countertop mounted. This frees up counter space while improving accessibility for all users, relative to a conventional shelf-mounted or wall-mounted microwave. For example, this arrangement is convenient to many users, adults and children, who are not tall enough to safely reach a shelf mounted microwave and lift down hot dishes or other items. Additionally, it does not permanently occupy the underlying counter space that would be used by placing the microwave on the counter. This arrangement for a cooking appliance is also convenient for small kitchens with limited counter space, since the underlying counter top space is available while cooking and/or when the oven is not in use.

Although embodiments of the invention have been described and illustrated in detail, it is to be clearly understood that the same is by way of illustration and example only and not to be taken by way of limitation, the scope of the present invention being limited only by the appended claims.

The invention claimed is:

1. A cooking appliance comprising:

a unit comprising a housing containing a cooking chamber (oven) for wall-mounting above a countertop, the cooking chamber having a bottom-opening door that provides, on its upper surface, a platform for items to be cooked;

a door lift system having, stationary guide rails mounted to a wall vertically beneath the cooking chamber, with the guide rails extending from a bottom of the housing of the cooking chamber to a countertop level, a support structure for carrying the door, the support structure comprising a support bar having at each end supports comprising bearings running in the guide rails, and the supports comprising arms for cantilever mounting of the door, and a motor driven lift mounted beneath the cooking chamber between the guide rails, the lift being operable for raising and lowering the support structure between a raised position for closing the door, and a lowered position with the door at countertop level; and a control panel remote from the cooking chamber and the door, for controlling oven functions and raising and lowering of the door.

2. A cooking appliance according to claim 1 wherein the motor driven lift comprises a scissor-jack type of lift driven by a worm gear and a motor.

3. A cooking appliance according to claim 1 further comprising a load sensor for sensing a weight imbalanced load or weight overload.

4. A cooking appliance according to claim 1 further comprising sensors for detecting objects impeding opening or closing of the door.

5. A cooking appliance according to claim 1 further comprising another door for accessing the cooking chamber from the front.

6. A cooking appliance according to claim 1 wherein the platform comprises a recessed area forming a drip tray.

7. A cooking appliance according to claim 1 wherein the control panel comprises an electronic control panel housed in a separate unit mounted near the countertop level, wherein the electronic control panel operates at a lower voltage than the cooking chamber.

* * * * *